US008981871B2

(12) United States Patent
Hanna et al.

(10) Patent No.: US 8,981,871 B2
(45) Date of Patent: Mar. 17, 2015

(54) HIGH DIRECTIVITY DIRECTIONAL COUPLER

(75) Inventors: Charles Hanna, Gardner, KS (US); Del Brandley, Moristown, NJ (US)

(73) Assignee: Honeywell International Inc., Morristown, NJ (US)

( * ) Notice: Subject to any disclaimer, the term of this patent is extended or adjusted under 35 U.S.C. 154(b) by 541 days.

(21) Appl. No.: 13/315,024

(22) Filed: Dec. 8, 2011

(65) Prior Publication Data

US 2013/0147576 A1 Jun. 13, 2013

(51) Int. Cl.
*H01P 5/18* (2006.01)
*H01P 5/16* (2006.01)
*H01P 5/19* (2006.01)

(52) U.S. Cl.
CPC .. *H01P 5/19* (2013.01); *H01P 5/16* (2013.01); *H01P 5/185* (2013.01)
USPC ..... 333/116; 333/109

(58) Field of Classification Search
CPC ..... H01P 5/18; H01P 5/184; H01P 5/19
USPC ..... 333/109, 110, 111, 112, 116
See application file for complete search history.

(56) References Cited

U.S. PATENT DOCUMENTS 5,666,090 A * 9/1997 Tsuruoka ..... 333/116

FOREIGN PATENT DOCUMENTS

EP 0256511 A2 2/1988
EP 2141764 A1 1/2010

OTHER PUBLICATIONS

Kazuhisa Yamauchi et al, "High Directivity Coupler Suppressing Leak Coupling with Cancellation Circuit of Wilkinson Divider", IEICE Transactions on Electronics, Jul. 1, 2010, pp. 1032-1037, vol. E93-C, No. 7, Institute of Electronics, Tokyo, JP.
European Search Report from counterpart European Application No. 12194919.2, dated Mar. 27, 2013, 3 pp.
Examination Report from counterpart European Application No. 12194919.2, dated Apr. 12, 2013, 4 pp.
Response to Examination Report dated Apr. 12, 2013, from counterpart European Application No. 12194919.2, filed Aug. 13, 2013, 12 pp.
Chen, et al., A High-Directivity Microstrip Directional Coupler With Feedback Compensation, National Chung Cheng University, Department of Electrical Engineering, Chiayi, 621, Taiwan, 0-7803-7239-5/02 2002 IEEE; Aug. 7, 2002.
Chun, et al., Microstrip line directional couplers with high directivity, Electronics Letters, Mar. 4, 2004, vol. 40 No. 5.
Lee, et al., An Inductor-Loaded Microstrip directional Coupler for Directivity Enhancement, IEEE Microwave and Wireless Componenets Letters, vol. 19 No. 6, Jun. 2009.
Kim, et al., A Design of Microstrip Directional Coupler for High Directivity and Tight Coupling, Div. of Information Technology Eng., Soonchunhyang Univ., Chungnam, R.O. Korea, Netel Inc. Seoul, R.O. Korea, Telecommunication Basic Research Lab., ETRI, R.O. Korea (REFS dated 1982, 1970, 1978, 1999, 1963, 1996 and 1997).

* cited by examiner

*Primary Examiner* — Dean Takaoka
(74) *Attorney, Agent, or Firm* — Shumaker & Sieffert, P.A.

(57) ABSTRACT

Systems and methods for achieving high directivity (>20 dB) coupling over a reasonable frequency bandwidth on a microstrip transmission line. An exemplary coupler cancels out-of-phase, coupled reflected power signals on the transmission line thereby increasing the directivity.

12 Claims, 4 Drawing Sheets

HIGH DIRECTIVITY DIRECTIONAL COUPLER

BACKGROUND OF THE INVENTION

Standard RF/microwave couplers etched on microstrip have very poor directivity, typically ~5 dB. Other modified microstrip couplers can achieve 20 dB directivity, but involve narrow etched line widths and spacings that require tight etching tolerances that may not be achievable or repeatable for low cost, high volume production. Also, these modified designs cannot be analyzed for proper function with standard linear simulators. They can only be analyzed with more sophisticated and expensive electromagnetic (EM) simulators. Without an EM simulator, a modified design with improved directivity is not possible in any kind of cost effective or timely manner.

SUMMARY OF THE INVENTION

The present invention solves the problem of achieving high directivity (>20 dB) coupling over a reasonable frequency bandwidth on a microstrip transmission line without the need for EM simulation, narrow line widths/spacings, or tight tolerances. The present invention can be implemented in any type of transmission line. It is especially suited to microstrip transmission lines.

An exemplary coupler device includes a combiner, first and second coupling units connected between the combiner and a to-be-measured transmission line. The first and second coupling units comprise first and second coupling devices being in electrical communication with a to-be-measured transmission line, at least one first transmission line coupled between the combiner and the first coupling device and at least one second transmission line coupled between the combiner and the second coupling device. The at least one first and the at least one second transmission line have predefined impedance and phase delay values. The phase delay value of the at least one first transmission line differs from the phase delay value of the at least one second transmission line based on a phase delay value of the to-be-measured transmission line.

In one aspect of the invention, the impedance of the at least one first transmission line is approximately equal to the impedance of the at least one second transmission line.

In another aspect of the invention, the combiner has an isolation value generally greater than 20 dB.

In still another aspect of the invention, each of the first and second coupling units includes a load resistor coupled between a node that is between an end of the first and second transmission lines and the respective coupling device and an electrical ground. The combiner has an isolation value generally less than 20 dB.

In yet another aspect of the invention, the at least one first transmission line comprises first and second sub transmission lines and the at least one second transmission line comprises first and second sub transmission lines. The first sub transmission lines have first ends connected to the coupling device. Each of the first and second coupling units includes a load resistor coupled to second ends of the first sub transmission lines and first ends of the second sub transmission lines. Second ends of the second sub transmission lines are coupled to the coupling devices. Phase delay for at least one of the first or second sub transmission lines is equal.

In still yet another aspect of the invention, the to-be-measured transmission line is located between a transmitter and an antenna.

BRIEF DESCRIPTION OF THE DRAWINGS

Preferred and alternative embodiments of the present invention are described in detail below with reference to the following drawings.

DETAILED DESCRIPTION OF THE INVENTION

Figure 1:
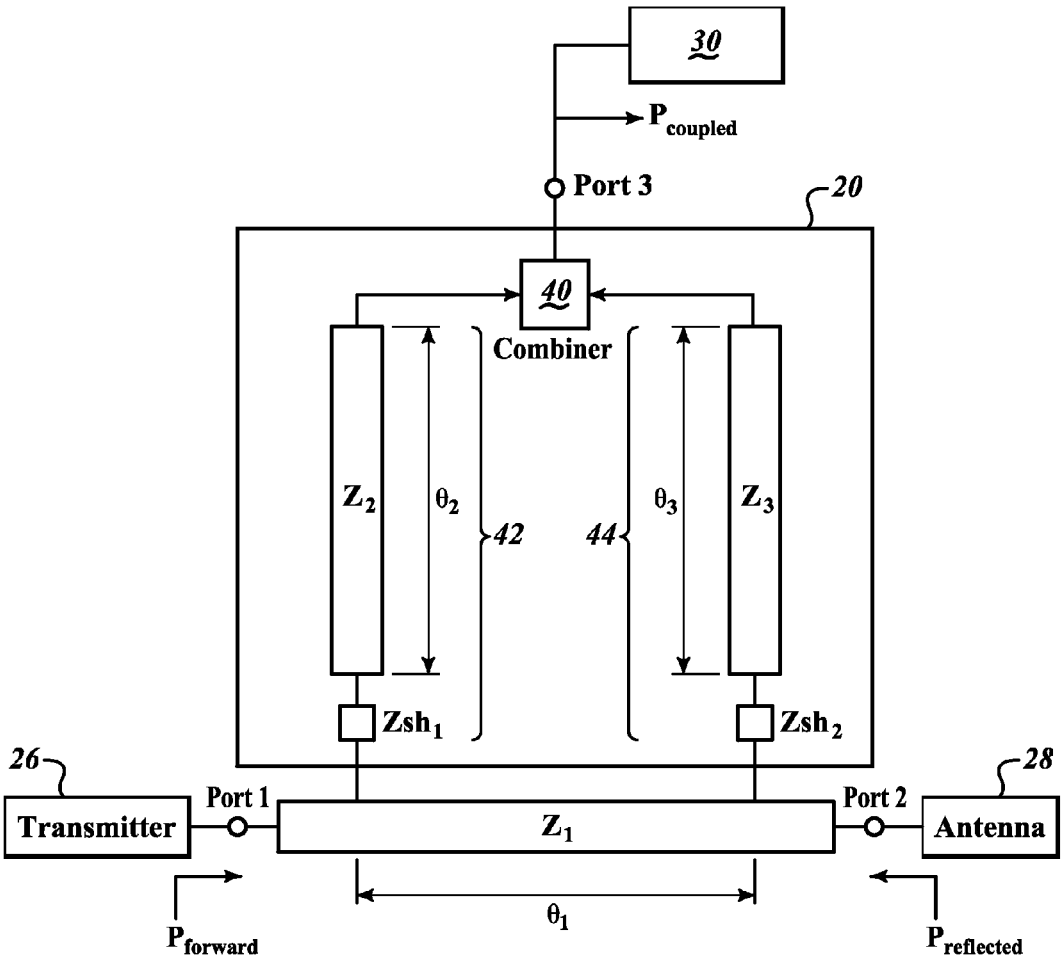
FIGS. 1-3 are schematic drawings showing different configurations formed in accordance with embodiments of the present invention.

FIG. 1 shows an exemplary microstrip coupler 20 that is capable of coupling power in a forward direction ($P_f$) on a transmission line $Z_1$, while coupling very little reflected power ($P_r$) along the same transmission line $Z_1$, thus achieving high directivity.

In one embodiment, the coupler 20 is used to detect $P_f$ along the microstrip transmission line $Z_1$ located between a transmitter 26 and an antenna 28. The coupler 20 sends a sensed power value to a Power Detector Circuit 30.

The Power Detector Circuit 30 transforms the RF power to a voltage level that is proportional to the RF power level. The voltage is then sent to a field programmable gate array (FPGA) for processing.

The coupler 20 includes a combiner 40 and a first coupler unit 42 and a second coupler unit 44. Each coupler unit 42, 44 includes a coupling device (e.g., resistive, inductive or capacitive device) and a predefined lengths of transmission line $Z_2$, $Z_3$. The lengths depend on the type of combiner (i.e. in phase or quadrature type combiner). For example, resistive coupling is achieved with a chip or thin film resistor, capacitive coupling is achieved with a chip, printed or gap capacitor. The combiner 40 has reasonably high isolation (i.e. Wilkinson, branch line, rat race hybrid, or comparable combiner). Generally greater than 20 dB is considered a high isolation value.

For the case of the combiner being a Wilkinson (in phase type combiner), let impedance for the microstrip transmission lines be as follows $Z_1=Z_2=Z_3=50$ Ohm, and $Z_{sh1}$ and $Z_{sh2}$ have gap capacitance values of 0.029 pF, an approximate 37 dB coupling is achieved. Also let the phase delays for the respective microstrip transmission lines be as follows $\theta_1=90°$, $\theta_2=90°$, and $\theta_3=0°$ at a particular frequency $f_o$, $f_o$ is the expected frequency of the transmitted signal.

Forward power enters Port 1 and exits at Port 2. A small amount of forward power $P_f$ is coupled off from $Z_{sh1}$, travels thru $Z_2$ and is incident on the combiner at −90°. Forward power $P_f$ travels thru $Z_1$ and a small amount of $P_f$ is coupled off from $Z_{sh2}$, travels thru $Z_3$ and is incident on the combiner at −90°. The two coupled signals from forward power $P_f$ are incident on the combiner 40 in phase and thus are added.

The reflected (or reverse) power $P_r$ enters Port 2 and exits at Port 1. A small amount of reflected power $P_r$ is coupled off from $Z_{sh2}$, travels thru $Z_3$ and is incident on the combiner at 0°. Reflected power travels thru $Z_1$ and a small amount is coupled off from $Z_{sh1}$, travels thru $Z_2$ and is incident on the combiner at −180°. The two coupled signals from reverse power $P_r$ are incident on the combiner 40 180° out of phase and thus are canceled.

Directivity is defined as forward coupled power minus reflected coupled power, typically expressed in dB. Theoretical analysis indicates directivity to be ≥20 dB for a bandwidth of about 19% for the above values of $Z_1$, $Z_2$, $Z_3$, $Z_{sh1}$ and $Z_{sh2}$ when using a Wilkinson combiner.

Different values of phasing for $\theta_1$, $\theta_2$ and $\theta_3$ will be required when using a branch line, rat race or other hybrid as the combiner as one of ordinary skill would be able to determine. Different values for $Z_1$, $Z_2$, $Z_3$, $Z_{sh1}$ and $Z_{sh2}$ will result in different coupling, directivity and bandwidths. The values can be different, but typically $Z_1=Z_2=Z_3$ and $Zsh_1=Zsh_2$.

Figure 2:
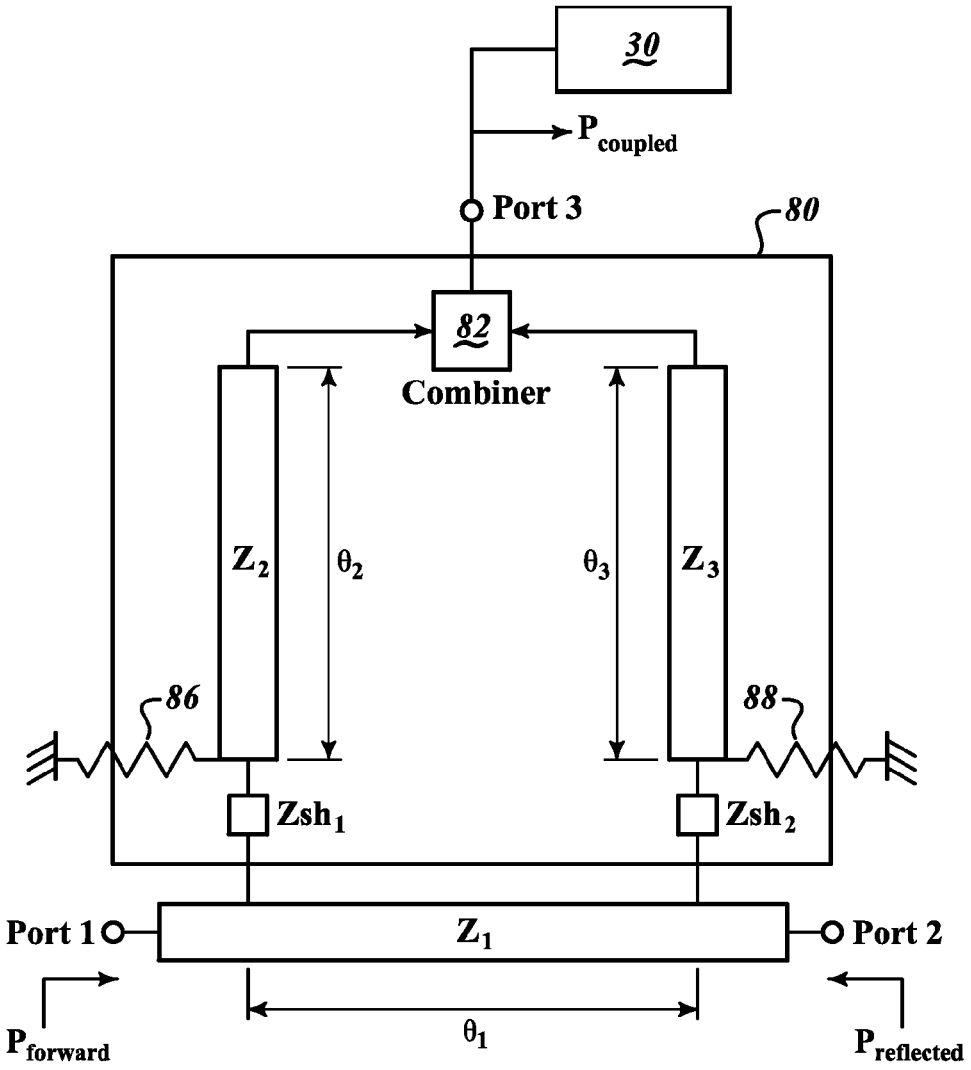

FIG. 2 illustrates a coupler 80 with a combiner 82 that has lower isolation (i.e. broadband resistive "star" or "tee"). Operation of the coupler 80 is basically the same as the coupler 20 shown in FIG. 1. Two load resistors 86, 88 improve the directivity when the isolation of the combiner 82 is lower than 20 dB. As an example, when using a broadband resistive "star" combiner (isolation ~6 dB), the directivity of the coupler 80 is ~6.3 dB without load resistors 86, 88, and >20 dB with load resistors 86, 88.

Figure 3:
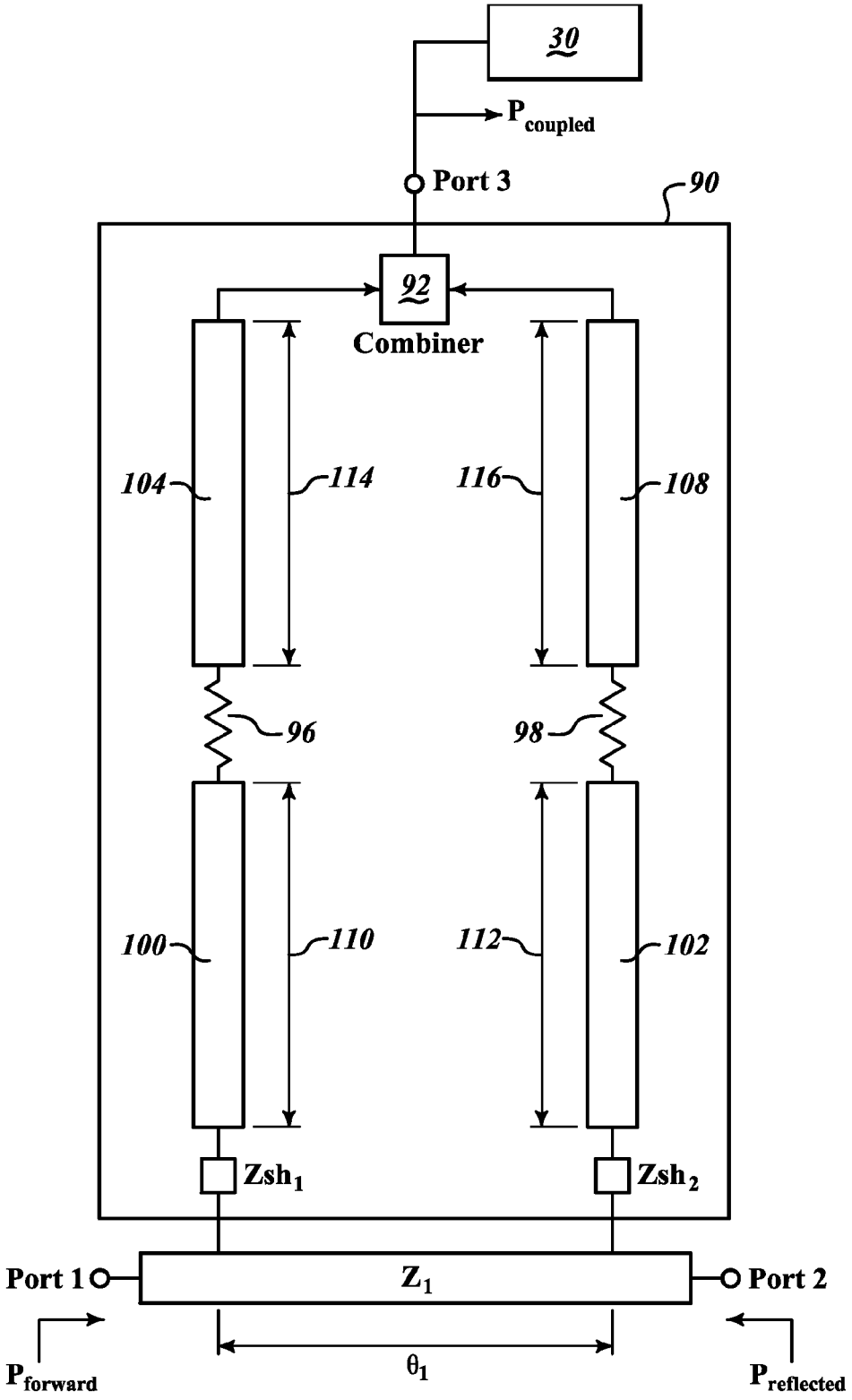

FIG. 3 illustrates a coupler 90 having a combiner 92 that has lower isolation (i.e. broadband resistive "star" or "tee"). The coupler 90 includes load resistors 96, 98 that are placed between first microstrip transmission lines 100, 102 and second microstrip transmission lines 104, 108. This is different than the coupler 80 shown in FIG. 2; the ground on the resistors have been replaced with $\lambda/4$ transmission lines 100, 102 that have the same phase delay 110, 112)(~90°). $\lambda$ is the expected wavelength of the received signal. $\lambda/4$ transmission line transforms an open circuit to a short circuit, thereby creating a virtual ground. $Zsh_1$ and $Zsh_2$ have extremely high impedance, almost an open circuit. This extremely high impedance transforms to an extremely low impedance through the $\lambda/4$ transmission lines 100, 102.

The coupler includes a second set of microstrip transmission lines 104, 108 with respective phase delay 114, 116 that is equal to the transmission lines Z2, Z3 shown in FIG. 2. Phase delay of sub transmission lines 100, 102 are equal and generally 90 degrees. Phase delay of transmission lines 104, 108 are not necessarily equal.

Figure 4:
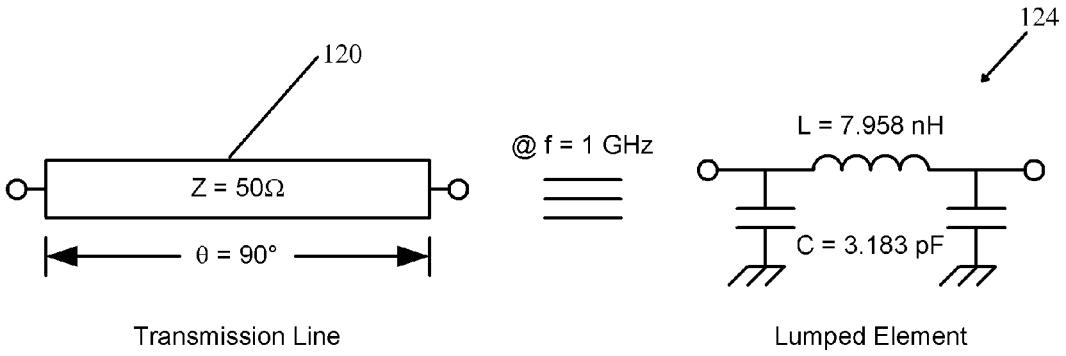
FIG. 4 shows a transmission line with an equivalent in capacitors and an inductor.

FIG. 4 shows that a transmission line, like the ones described above, can be replaced by other circuit components and still provide the same capabilities. A transmission line 120 is an etched trace on a circuit board with a specific width and length that achieves 50 Ohm and 90 degrees phase delay. A lumped element circuit 124 is electrically equivalent at a frequency of 1 GHz for the values given. Thus, in particular for lower frequency applications, a lumped element circuit or other transmission line equivalent could replace the transmission lines described above.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A power coupler device comprising:

a combiner;

first and second coupling units connected between the combiner and a to-be-measured transmission line, the first and second coupling units comprise:

first and second coupling devices being in electrical communication with the to-be-measured transmission line;

at least one first transmission line coupled between the combiner and the first coupling device; and at least one second transmission line coupled between the combiner and the second coupling device, wherein the at least one first and the at least one second transmission lines have predefined impedance and phase delay values, wherein the phase delay value of the at least one first transmission line differs from the phase delay value of the at least one second transmission line based on a phase delay value of the to-be-measured transmission line, and wherein the combiner has an isolation value greater than 6 dB between the at least one first transmission line and the at least one second transmission line.

2. The device of claim 1, wherein the impedance of the at least one first transmission line is equal to the impedance of the at least one second transmission line.

3. The device of claim 1, wherein the combiner has an isolation value greater than 20 dB between the at least one first transmission line and the at least one second transmission line.

4. The device of claim 1, wherein each of the first and second coupling units comprise:

a load resistor coupled between a node that is between an end of the first and second transmission lines and the respective coupling device and an electrical ground.

5. The device of claim 4, wherein the combiner has an isolation value less than 20 dB between the at least one first transmission line and the at least one second transmission line.

6. The device of claim 1, wherein the at least one first transmission line comprises first and second sub transmission lines and the at least one second transmission line comprises first and second sub transmission lines, wherein the first sub transmission lines have first ends connected to the combiner, wherein each of the first and second coupling units comprise:

a load resistor coupled to second ends of the first sub transmission lines and first ends of the second sub transmission lines, wherein second ends of the second sub transmission lines are coupled to the coupling devices, wherein phase delay for at least one of the first or second sub transmission lines is equal.

7. The device of claim 6, wherein the combiner has an isolation value less than 20 dB between the at least one first transmission line and the at least one second transmission line.

8. The device of claim 1, wherein the to-be-measured transmission line is located between a transmitter and an antenna.

9. A method comprising:

at a first location on a transmission line, coupling a first power signal to a first coupler transmission line, the first coupler transmission line being coupled to a combiner;

at a second location on the transmission line, coupling a second power signal to a second coupler transmission line, the second coupler transmission line being coupled to the combiner;

at the first coupler transmission line, causing a first phase delay of the coupled first power signal;

at the second coupler transmission line, causing a second phase delay of the coupled second power signal; and at the combiner, combining the coupled first and second power signals, thereby providing, from the combiner, a sensed power of a forward power signal on the transmission line, wherein the first phase delay differs from the second phase delay based on a third phase delay of the forward power signal on the transmission line, and wherein the combiner has an isolation value greater than 6 dB between the first coupler transmission line and the second coupler transmission line.

10. The method of claim 9, wherein the transmission line is located between a transmitter and an antenna.

11. A system comprising:

at a first location on a transmission line, a means for coupling a first power signal to a first coupler transmission line, the first coupler transmission line being coupled to a combiner;

at a second location on the transmission line, a means for coupling a second power signal to a second coupler transmission line, the second coupler transmission line being coupled to the combiner;

at the first coupler transmission line, a means for causing a first phase delay of the coupled first power signal;

at the second coupler transmission line, a means for causing a second phase delay of the coupled second power signal; and at the combiner, a means for combining the coupled first and second power signals, thereby providing, from the combiner, a sensed power of a forward power signal on the transmission line, wherein the first phase delay differs from the second phase delay based on a third phase delay of the forward power signal on the transmission line, and wherein the combiner has an isolation value greater than 6 dB between, the first coupler transmission line and the second coupler transmission line.

12. The device of claim 1, wherein the combiner comprises one of an in-phase type combiner or a quadrature type combiner, and wherein the predefined impedance and phase delay values of the at least one first and the at least one second transmission lines are dependent on the type of the combiner.

* * * * *